United States Patent [19]

Jantzen

[11] Patent Number: 4,460,085

[45] Date of Patent: Jul. 17, 1984

[54] PORTABLE TOOL-CHEST

[76] Inventor: Eric Jantzen, 38 Avenue Thierry, Ville d'Avray, France, 92410

[21] Appl. No.: 411,643

[22] Filed: Aug. 26, 1982

[30] Foreign Application Priority Data

Sep. 10, 1981 [FR] France ..... 81 17168

[51] Int. Cl.[3] ..... A45C 11/26

[52] U.S. Cl. ..... 206/349; 206/373; 206/372; 312/DIG. 33; 220/94 R

[58] Field of Search ..... 206/216, 349, 372, 373, 206/374, 375, 376, 378, 379, 523, 803; 220/94, 902; 312/DIG. 33

[56] References Cited

U.S. PATENT DOCUMENTS

| | | | |
|---|---|---|---|
| 1,785,666 | 12/1930 | Bachelder | 312/252 |
| 4,140,256 | 2/1979 | King | 206/373 |
| 4,201,293 | 5/1980 | Rigazio et al. | 206/523 |
| 4,240,684 | 12/1980 | Henning | 312/DIG. 33 |
| 4,286,832 | 9/1981 | Spevak | 312/283 |
| 4,288,134 | 9/1981 | Knaack et al. | 312/DIG. 33 |
| 4,294,348 | 10/1981 | Hastings | 206/373 |
| 4,303,158 | 12/1981 | Perkins | 206/373 |

*Primary Examiner*—Joseph Man-Fu Moy
*Assistant Examiner*—David T. Fidei
*Attorney, Agent, or Firm*—Shenier & O'Connor

[57] ABSTRACT

The tool-chest comprises a rigid frame with deep storage compartments forming a central well, a base receptacle with other storage compartments located around the central well, and a level of tool suspensions on the periphery of the central well above the base receptacle; and a removable rigid lid designed to fit over guiding means provided on the rigid frame, said lid having a flat upper face provided with a recessed portion and an opening to allow the passage and housing-in of a frame handle topping the frame, the lid being adapted to serve as a stool or as steps.

14 Claims, 7 Drawing Figures

Figure 1:
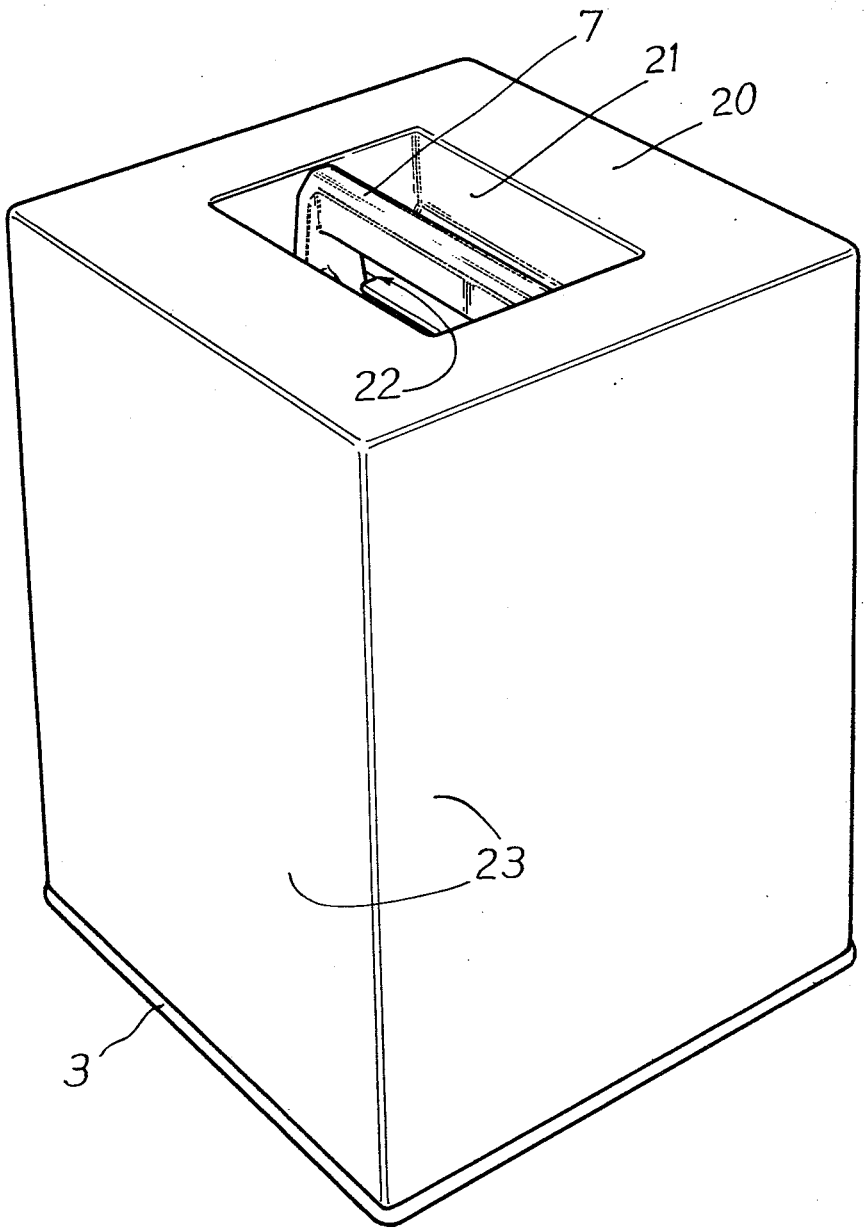

Fig. 5
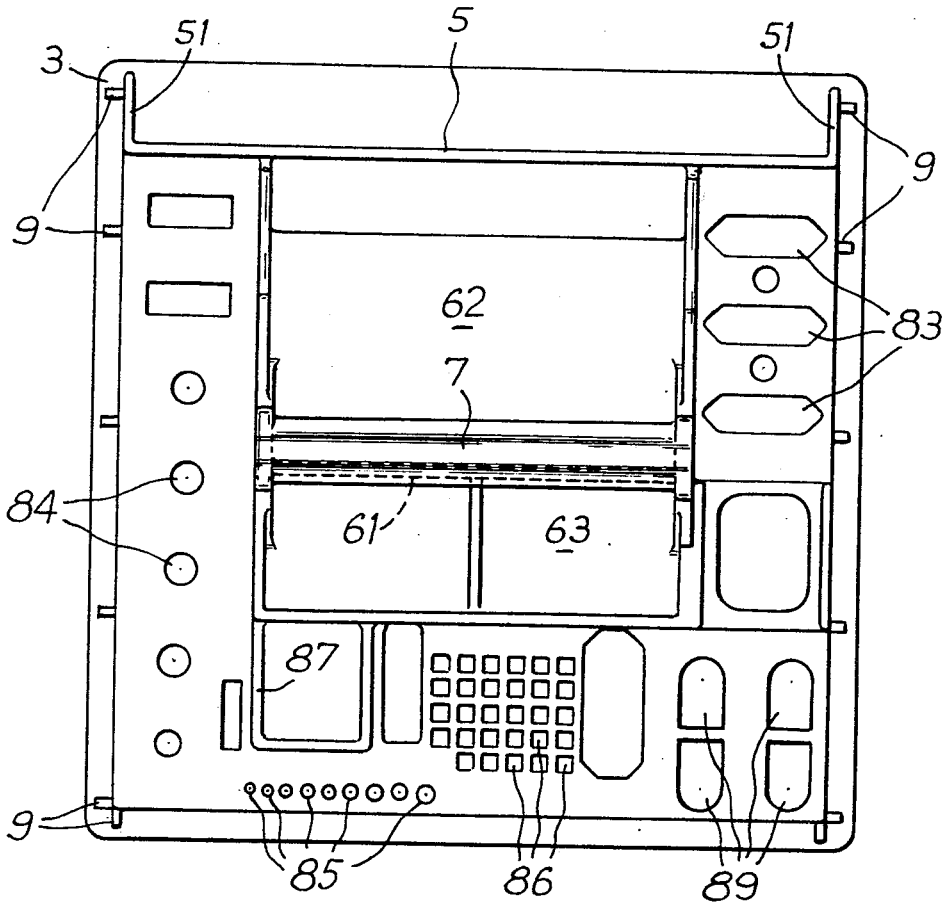
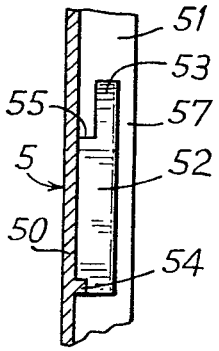
Fig. 7

PORTABLE TOOL-CHEST

The present invention raltes to a portable tool-chest comprising a rigid frame equipped with a flat base, means to hold a variety of tools and spare parts, and a handle situated at the upper part of the frame, with a removable rigid lid adapted to cover entirely the frame.

Different types of tool-carrying units are known, such as for example tool-kits or tool boxes with movable compartments which can be superimposed for storage, and spread out when being used. But all these different portable units, which are designed to re-group inside a small space a variety of small do-it-yourself equipment, including a number of basic tools and spare parts such as small articles of ironware, present a number of disadvantages. In the first place, the deformable nature of the tool support, which has to be folded over to a small volume, for tool storage or transport purposes, and unfolded when being used, to give access to the different tools on the set, makes the whole unit rather flimsy due to the frequent pulling movements imposed on the deformable movable elements. In the second place, the space taken by the tool-kit- or tool-box, when spread out for use is often excessive, and it is necessary to close-up the whole unit everytime the user moves to another spot, which is inconvenient, especially on a working site where works are required in separate places. In the third place, the known tool-carrying implements can only store a limited variety of tools, which generally excludes those apparatus such as hand-drills. And lastly, with the conventionally known tool-kits or tool-boxes, the worker still has to call on other equipments such as steps, in order to work in the best possible conditions.

It is also known to use a tool-display unit which comprises a rigid frame on which are suspended various tools, the frame being provided with a carrying handle. This type of tool-box is easier to use insofar as the tools distributed over the frame are easily accessible, but the tools are not always secured in position and the display unit is difficult to store.

It is precisely the object of the present invention to overcome the aforesaid disadvantage by proposing a portable unit of the tool-box type, in which a variety of basic tools and spare parts can be regrouped in such a way that they are simultaneously stored and displayed in compact and accessible form.

A further object of the invention is to produce a tool-carrying unit which is easy to store and has the added function, both when the tools are used and not used, of a stool or of steps.

These objects are reached, according to the invention, with a portable tool-chest of the type defined hereinabove, wherein the frame comprises a vertical central well constituted by deep storage compartments extending over nearly the whole height of the frame, a base receptacle comprising storage compartments of smaller height placed at the base of the frame around the central well, at least one level of tool suspensions on the periphery of the central well above the base receptacle, and lid-guiding means situated on the periphery of the base receptacle and/or of the tool suspension level, and wherein the lid is designed to fit over the said guiding means, the said lid having a flat upper face provided in its center with a recessed portion and an opening to allow the passage and housing-in of the frame handle underneath said flat upper face when the lid is placed over the frame.

The combination of the above-defined features enables to re-group, within a compact and portable form, a complete set of do-it-yourself tools, basic universal tools suspended at the tool-suspension level or on the vertical panel, or stored in the central well, depending on their overall size and shape, as well as small ironware or other spare parts which can be stored for example in the compartment of the base receptacle. The staggered disposition of the elements on several horizontal levels around a central well, on a vertical plane and inside the central well, gives simultaneously ready access to the different elements which are fixed in position for a compact storage. In addition, the lid which covers the frame and is guided thereon both by the vertical panel and by guiding elements situated all around the periphery of the frame, provides a protection and safe hold on the different tools, whilst fulfilling its additional function which is to provide a support of the stool type, this because of its rigidity and of the absence of projecting elements on its horizontal upper face.

According to one special feature of the invention, the frame comprises at least one vertical panel forming a rack, and the lid fits over the frame by cooperating with said vertical panel and with said guiding means situated on the periphery of the frame. Said vertical panel forming a rack can then constitute a back face of the frame which is parallel to one of the faces of the lid when the latter is fitted over the frame and forms one of the walls of said vertical central well.

Preferably, the lid has the overall shape of a cylinder, with a convex polygon as a base. According to the simplest configuration, the lid, constituted by an upright cylinder of quadrilateral base, thus takes on a parallelepipedal shape, particularly easy to store or to stack.

Advantageously, the height of the lid is approximately between the largest dimension of the flat base of the frame and twice that dimension.

This higher-than-wide design gives ready access to the different tools and makes the lid better adapted to act as a stool or as steps.

According to a special embodiment of the invention, the base receptacle comprises drawers situated directly above the flat base and over the entire extent thereof, and compartments or racks, open at the top, which are situated inside the said drawers, around the central well.

According to another special feature, the tool suspension level comprises a flange over at least part of the periphery of the central well, at a certain height above the base receptacle, the said flange having a vertical part parallel to the faces of the lid situated at a small distance thereof when the lid is fitted on, and a horizontal part which is joined to the walls of the central well and is provided with orifices of various dimensions and shapes, in which the tools are suspended.

Advantageously, the orifices provided in the flange are equipped with sleeves to guide the passage of the tools over part of their height.

Small compartments can be disposed around the central well and joined to the flange of the tool suspension level.

The flange of said tool suspension level can comprise staggered parts at different levels to support tools of various heights.

According to yet another special feature of the invention, the panel forming rack comprises means for holding flat-type spanners, which means are constituted by grooves, widening out towards the top, and provided at their upper part with lugs permitting the housing-in of the spanners heads, abutments being provided at the lower part of said grooves to keep the lower part of the spanners apart from the plane of the panel.

Advantageously, the frame and the lid are produced from a rigid plastic material and each can be monobloc or made up from a small number of monobloc parts.

The lid, which is optionally equipped with reinforcements, can be provided with a non-slip relief on its upper horizontal surface.

Preferably, the frame comprises a flat base slightly projecting from the plane of the walls of the base receptacle and from the vertical panel, to receive the lower edges of the lid and the lid-guiding means comprise vertical ribs distributed at the lower part of the vertical faces of the base receptacle.

Advantageously, the vertical panel forming a rack and the handle topping the central well are substantially of the same height.

Figure 2:
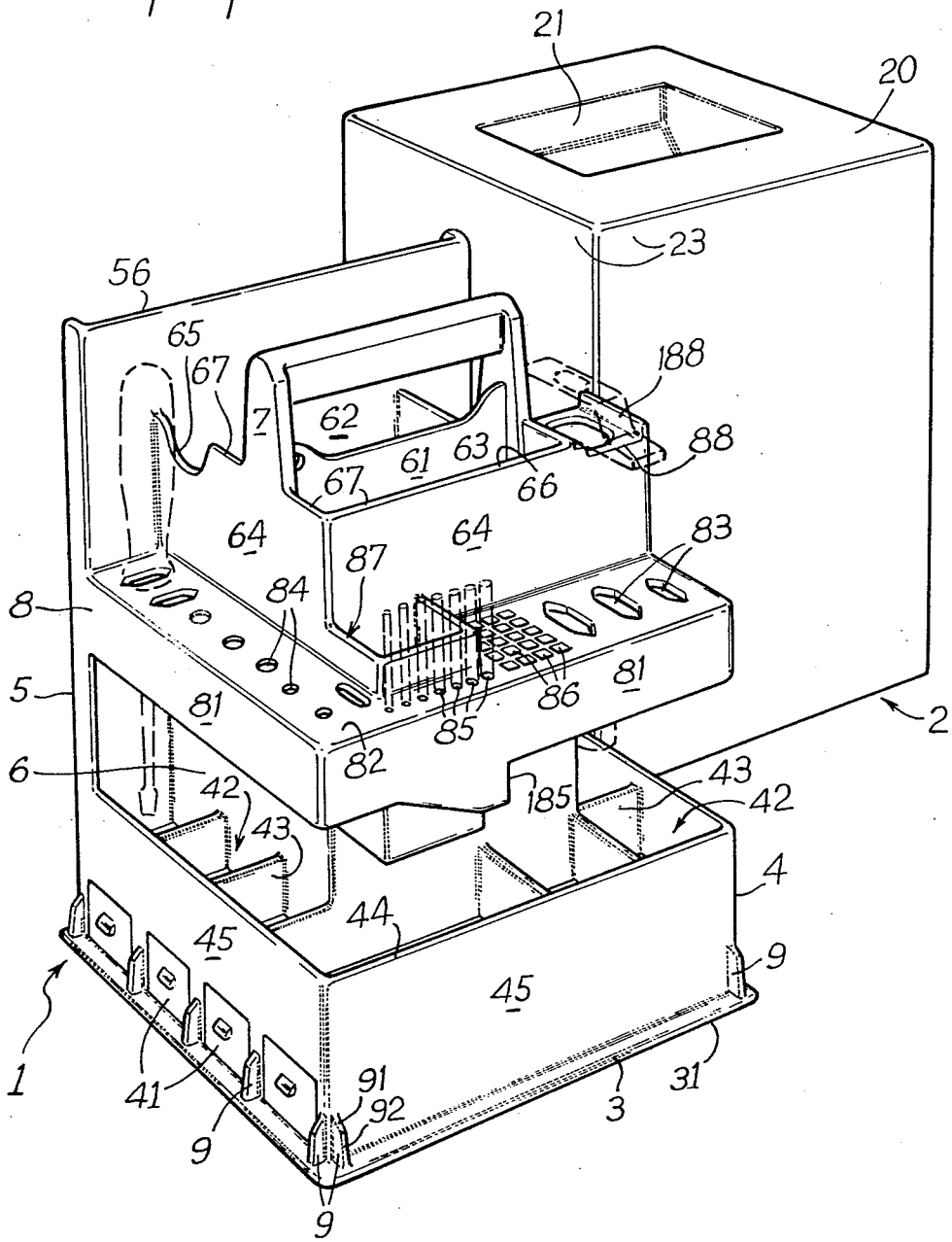
Figure 3:
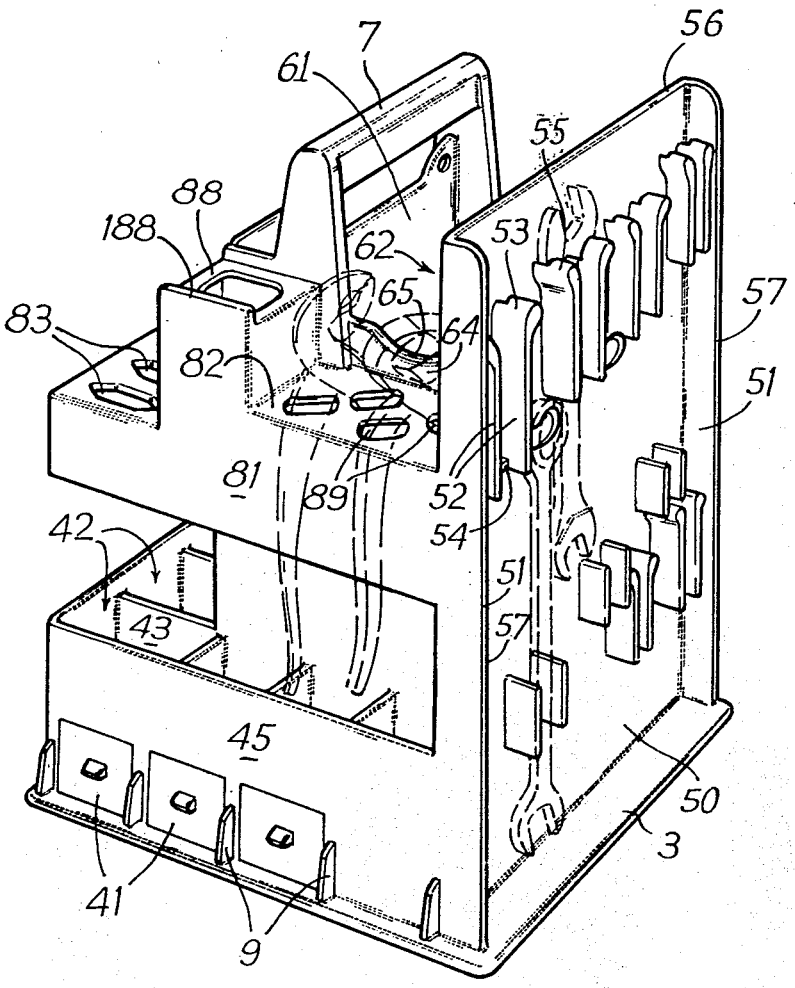
Figure 4:
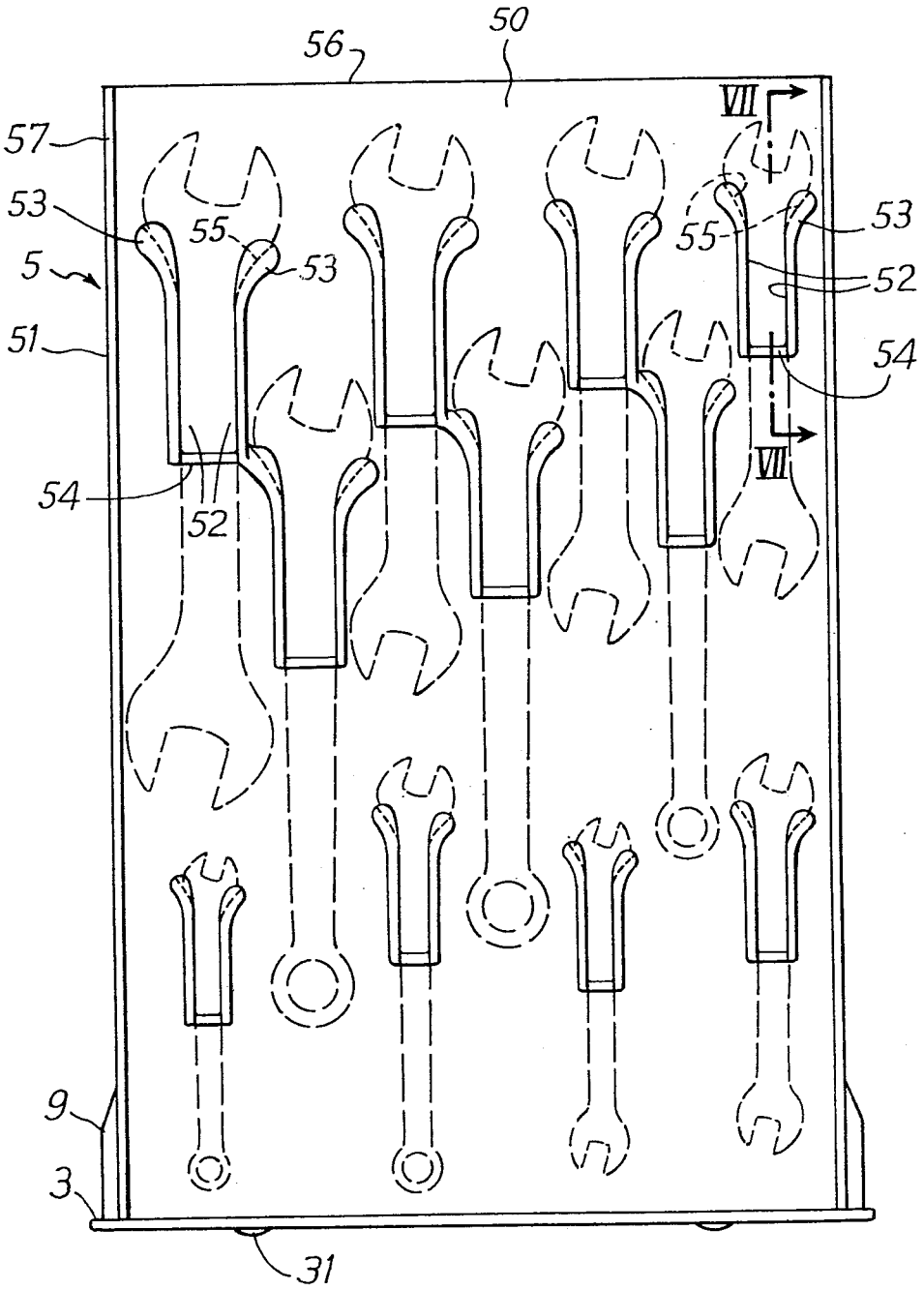
Figure 6:
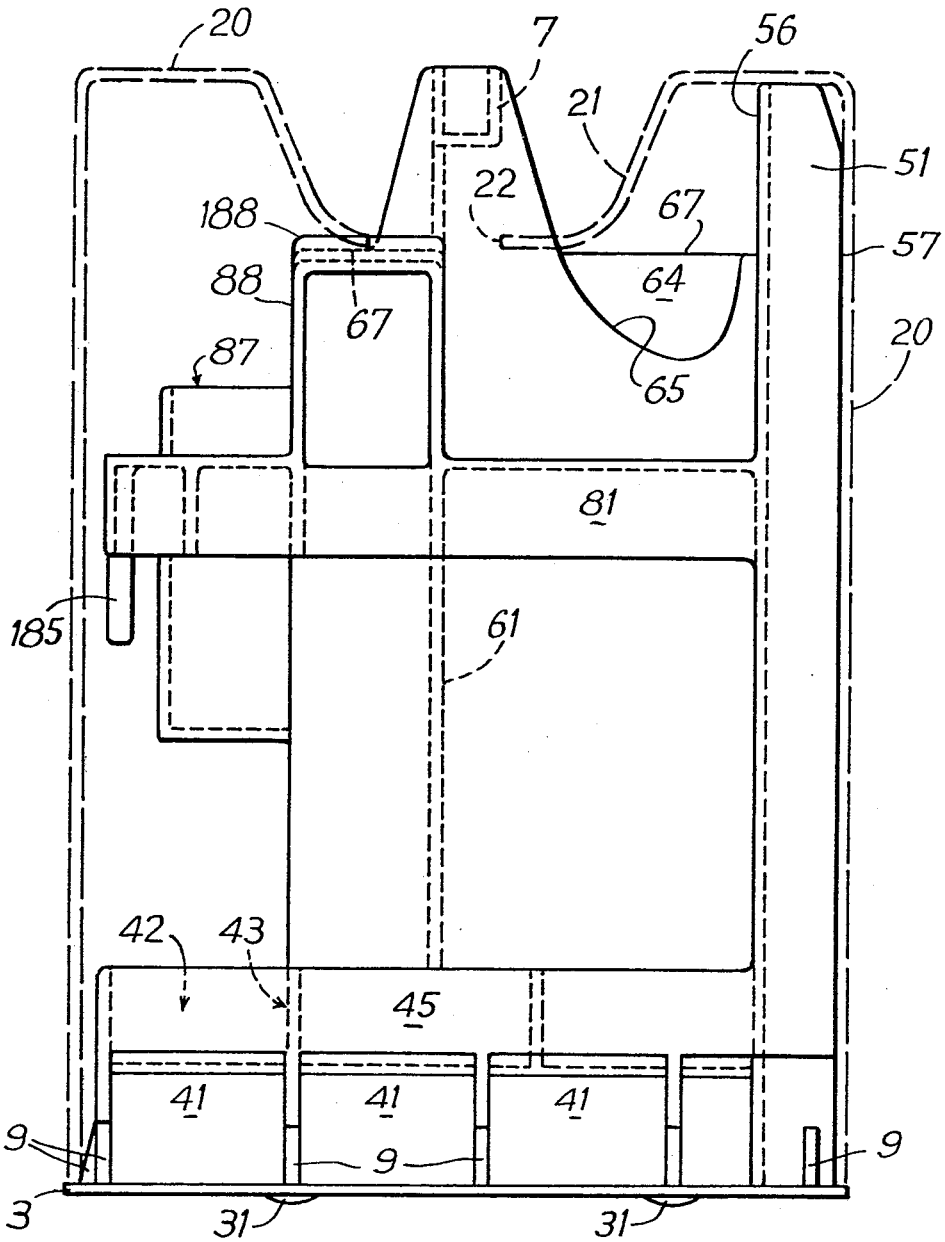

The invention will be more readily understood on reading the following description with reference to the accompanying drawings in which:

FIG. 1 is a perspective view of the portable tool-chest according to the invention, in a closed storage position, FIG. 2 is a perspective view of the portable tool-chest of FIG. 1, in the position of use, with the lid off the frame, FIG. 3 is another perspective view of the frame of FIG. 2, showing the back part of said frame, FIG. 4 is a plan view of the back face of the frame forming a vertical rack, FIG. 5 is a view from above of the tool-chest according to the invention showing one possible arrangement of the tool suspension means, FIG. 6 is an elevational view of the frame of FIGS. 2 and 3, and FIG. 7 is a detailed view of a section along line VII—VII of FIG. 4.

FIG. 1 shows a tool-chest according to the invention, in the closed position of storage. In that position, a rigid lid 2, for example in plastic material, of parallelepipedal shape, covers entirely a tool-supporting frame, of which only the base 3 which slightly projects from the vertical walls 23 of the lid 2, and the upper handle 7 are visible, which base 3 or footing projects slightly from the vertical walls 23 of the lid 2, and which handle 7 traverses an opening 22 provided in a recessed portion 21 of the upper part of the lid 2. Said lid 2 presents four vertical flat faces 23 and a horizontal flat face 20 which can if necessary be grooved or have any other type of non-slip surface. The handle 7 housed in the recessed portion 21 of the lid 2 is entirely situated beneath the plane of the horizontal upper face 20 of the lid 2, so that a plurality of tool-chests of the type illustrated in FIG. 1, can easily be shacked one on the top of the other. Rims or shoulders 66, 67 of the frame 1 (see FIGS. 2 and 6), not shown in FIG. 1, cooperate with the lower face of the horizontal upper wall 20 of the lid 2, provided with its recessed portion 21, to allow the simultaneous transport of the frame 1 and of the lid 2 when the tool-chest is grasped by its handle.

In addition, the tool-chest is presented as being higher than wide, which means that the lid 2 has vertical faces 23 preferably a little higher than the base 3 or footing of the frame 1. Owing to this, it becomes possible to deposit tools on the frame 1 in the vertical position (see FIGS. 2 and 3) and to have a tool-chest which, because of its rigid and optionally reinforced lid 2, can also be used as a stool or as steps. The height of the lid 2 can be, for example, approximately between 35 and 50 cm, whereas the base 3 or footing of the frame can be rectangle with a small side of approximately between 20 and 30 cm in length, and a long side of approximately between 30 and 60 cm in length.

It will be noted that the mechanical strength of the lid is such that said lid can support a person both when it is fitted bell-like over the frame (FIG. 1) and when it is removed from said frame (FIG. 2) to give access to the various tools placed on the frame. Moreover, the closed assembly 1, 2 can easily be locked with a padlock which is housed in the recessed portion 21.

FIGS. 2 and 3 show the general structure of the frame 1 which rests on the ground by way of a flat base 3 forming footing, but which can optionally be provided with feet 31 or wheels, removably fitted if necessary. The frame 1 comprises a back face 5 which is flat and vertical and has dimensions corresponding substantially to those of a vertical face 23 of the lid 2. Said rear panel 5 acts both as a rack for a set of tools such as flat spanners or eye spanners (FIGS. 3 and 4) or as a guide for positioning the lid 2 on the frame 1, using to a maximum the space available inside the lid 2.

The frame 1 comprises one or more central vertical compartments 62, 63 extending substantially over the whole height of the frame and forming a deep well 6 defined by vertical walls 64 and the panel 5. The walls 64 of the central well 6 are topped by the handle 7 by which the whole frame assembly can be grasped. Said central well 6 can have vertical partition walls such as wall 61. Said central well is designed to allow the loose storage of tools of different length as well as bulky tools such as a hand drill for example. Indentations 65, can be provided at the upper part of the walls 64 to help grasping objects under the handle 7 or to wedge special tools in position. The upper horizontal rim 67 of the central well 6 also cooperates with the lower face of the upper wall 20 of the lid 2 when the latter is fitted over the frame (FIG. 6).

The frame is further provided with a base receptacle 4 situated directly on the base 3, and comprising various storage compartments 41, 42 all placed around the central well 6. Vertical walls 45 resting on the base 3 at a small distance from the rims thereof, define the base receptacle 4 on those sides not provided with a vertical panel forming rack. In the embodiment shown in FIGS. 2, 3 and 6, the base receptacle 4 comprises a first set of drawers 41 which extends over virtually all the surface of the footing 3 and can be arranged so as to open onto one, two or four faces and thus have a length equal to the entire transverse dimension of the footing 3, or to half or a quarter of said dimension. In the illustrated example, two sets of three drawers 41 are placed on two opposite faces 45 of the base receptacle. Above these drawers 41 are placed open compartments 42 provided with a bottom 44, and separated by intermediate walls 43 and being further limited, on the one hand, by the upper part of the walls 45 and, on the other hand, by the lower part of the walls 64 of the well 6. Said compartments 42, as well as said drawers 41 are adapted to receive for example small items such as nails, screws, bolts.

As can be seen in FIGS. 2 and 3 in particular, a tool-suspension level 8 is found around the initial well 6 at a certain height above the base receptacle 4. Said level 8 comprises a flange 81, 82 presenting a horizontal face 82 joined to the walls 64 of the well 6 and a vertical strip 81 composed of three flat faces superimposed on the walls 45 of the base receptacle and parallel to the corresponding vertical faces 23 of the lid 2. The flange 81, 82 comprises means for suspending a variety of standard tools such as pliers, screw-drivers, spanners, drills, files, etc.. Said suspension means are constituted by holes such as 83, 84, 85, 86 which are machined into sleeves so as to be tubular shaped over a certain height, and thus into sleeves so as to be tubular shaped over a certain height, and thus to ensure the guiding of the tools and to hold them in a substantially vertical position. Tools such as screw-drivers, files or universal pliers can be hooked on by their working end whereas tools such as adjustable pliers for example can be suspended by their handle side. In every case, the tubular shape of the holes, with a depth which is variable between 25 and 40 mm for example, prevents the tools from swaying. Some of the orifices are adaptable in shape and dimensions even to very specific tools. For example orifices 83 of polygonal shape prevent tools such as universal pliers, fitted-in head first, from being jammed in. Paired-up orifices 89 are also adapted to hold tools such as pliers or tongs engaged therein by their gripping arms. Other orifices 86 provided in a square-holed universal grid with tubular square holes, can be provided to hold tools of any design. Finally, the shape of the housings can be adapted to certain uses. For example, the tubular holes 85 formed within a sleeve 185, the base of which is slightly inclined, can be adapted to receive a set of drills of increasing length. FIG. 5 gives a plan view of an example of lay-out of holes or alveoli of different shapes adapted to various tools.

The tool-suspension level 4 can also comprise receptacles 87 able to hold anything, and backed against the well 6, or raised receptacles to receive a hammer type material, and comprising a central tubular bore to allow the passage of a tool handle, a horizontal upper platform to support the head of the tool and an external rim 188 which extends from the corresponding vertical walls 45, 81 and forms a stop member for an easy positioning of the lid 2 over the frame even when the latter is loaded with tools.

A rack-shaped embodiment of the vertical panel is shown in FIG. 4, with a detail being explicated in FIG. 7. The panel 5 comprises a base 50 and two vertical rims 51 perpendicular to the bottom 50 and situated in extension of the corresponding vertical side faces 45, 81. The vertical 57 and horizontal 56 edges of the panel 5 act as a guide for the lid 2. Grooves made up by two parallel vertical ribs at predetermined distance one from the other and projecting from the base 5 serve as guides for spanners or the like. The ribs 52 of each groove are completed at their upper part by lugs 53 which widen out to form abutments for the spanners heads. Indentations 55 provided between the bottom 50 and the lugs 53 prevent the spanners from tilting outwardly. A small transverse rib 54 provided at the lower part of the grooves 52 keeps the lower part of the spanners away from the bottom 50, so that the spanners are readily graspable whilst remaining locked in position. The gap in each groove 52 is adapted to different sizes of spanners and their length corresponds to approximately half that of the corresponding spanner. The grooves 52 are advantageously staggered.

As shown in the figures, the means for guiding the lid 2 on the frame 1 can comprise, besides the horizontal 56 and vertical 57 edges of the vertical back panel 5, the horizontal edges 67 and the outer edge of the footing 3 which projects from the lid, vertical ribs 9 distributed on the periphery of the walls 45 of the base receptacle 4, which rims are formed from the footing 3 and stop short of the outer edge 31 of the footing 3 corresponding substantially to the thickness of the vertical walls 23 of the lid at their lower part. Said ribs could also be provided on the vertical faces of the flange 81, 82. However, the ribs 9 produced at the bottom of the base receptacle 4 and presenting a first upper part 91 which is downwardly inclined and a second vertical lower part 92, afford an easier fitting of the lid 2 with play over most of the frame height, causing a sort of locking-in of the lid when the latter is completely fitted over the frame 1.

As already indicated hereinabove, the frame can be produced in one piece or it can be of modular design, and the vertical panel 5 forming a rack and/or the flange (81,82) placed on the periphery of the central well 6 can be so designed as to be removable. In this case, the tool-chest can easily be adapted to different uses and its production is rationalized since the main structure of the frame with the central well, the base receptacle, the handle, the guiding edges can be mass-produced whilst the different types of racks and flanges can be provided for specific sets of tools. Inasmuch as the vertical panel 5 also forms a partition for the central well 6, the removability of said panel can also give ready access to at least one compartment of the central well 6. In the case where the vertical panel 5 is produced so as to be removable, it is advantageous for the vertical side edges 51, and possibly also a small part of the bottom 50, to remain integral with the central well 6, whereas the central part of the rack is removable and is connectable onto the fixed portions for example by way of a hook-on or clipping-on system.

What is claimed is:

1. Portable tool chest comprising a rigid frame equipped with a flat base, means to hold a variety of tools and spare parts, and a handle situated at the upper part of the frame, with a removable rigid lid adapted to cover entirely the frame, wherein the frame comprises a vertical central well constituted by at least one deep storage compartment extending over nearly the whole height of the frame, a base receptacle comprising storage compartments of smaller height placed at the base of the frame around the central well, at least one level of tool suspensions around the central well above the base receptacle, at least one vertical panel comprising an outer face forming a rack limited by an upper horizontal edge and two vertical comparatively short side walls defining two vertical edges on the external part of the frame and lid-guiding means situated on the periphery of the base receptacle and/or of the tool suspension level, and wherein said vertical central well is topped by said handle, the lid is designed to fit over the said guiding means and said two edges and said upper horizontal edge of said at least one vertical panel, the said lid having a flat horizontal upper face provided in its center with a recessed portion and an opening to allow the passage and housing-in of the frame handle underneath said flat upper face when the lid is placed over the frame, said flat upper face of said lid being generally coextensive with the frame base to provide enclosed storage space surrounding said handle, said vertical panel forming a rack constituting a back face of the frame which is parallel to one of the faces of the lid when the latter is fitted over the frame and forms one of the walls of said vertical central well, and said lid having a height which is approximately between the largest dimension of the flat base and twice said dimension whereby said tool chest presents a higher than wide configuration.

2. Tool-chest as claimed in claim 1, wherein the frame comprises at least one vertical panel forming a rack, and the lid fits over the frame by cooperating with said vertical panel and with said guiding means situated on the periphery of the frame.

3. Tool-chest as claimed in claim 2, wherein said vertical panel forming a rack can then constitute a back face of the frame which is parallel to one of the faces of the lid when the latter is fitted over the frame and forms one of the walls of said vertical central well.

4. Tool-chest as claimed in claim 1, wherein the lid has the overall shape of a cylinder, with a convex polygon as a base. According to the simplest configuration, the lid, constituted by an upright cylinder of quadrilateral base, thus takes on a parallelepipedal shape, particularly easy to store or to stack.

5. Tool-chest as claimed in claim 1 or 2, wherein the base receptacle comprises drawers situated directly above the flat base and over the entire extent thereof, and compartments or racks, open at the top, which are situated inside the said drawers, around the central well.

6. Tool-chest as claimed in claim 1, wherein the tool suspension level comprises a flange over at least part of the periphery of the central well, at a certain height above the base receptacle, the said flange having a vertical part parallel to the faces of the lid situated at a small distance thereof when the lid is fitted on, and a horizontal part which is joined to the walls of the central well and is provided with orifices of various dimensions and shapes, in which the tools are suspended.

7. Tool-chest as claimed in claim 6, wherein the orifices provided in the flange are equipped with sleeves to guide the passage of the tools over part of their height, and hold them in position.

8. Tool-chest as claimed in claim 6, wherein small compartments can be disposed around the central well and joined to the flange of the tool suspension level.

9. Tool-chest as claimed in claim 3, wherein the panel forming rack comprises means for holding flat-type spanners, which means are constituted by grooves, widening out towards the top, and provided at their upper part with lugs permitting the housing-in of the spanners heads, abutments being provided at the lower part of said grooves to keep the lower part of the spanners apart from the plane of the panel.

10. Tool-chest as claimed in claim 1, wherein the frame and the lid are produced from a rigid plastic material.

11. Tool-chest as claimed in claim 1 or 2, wherein the frame comprises a flat base slightly projecting from the plane of the walls of the base receptacle and from the vertical panel, to receive the lower edges of the lid and the lid-guiding means comprise vertical ribs distributed at the lower part of the vertical faces of the base receptacle.

12. Tool-chest as claimed in claim 3, wherein the vertical plane forming a rack and the handle topping the central well are substantially of the same height.

13. Tool-chest as claimed in claim 3, wherein the vertical panel forming rack is produced in a removable form.

14. Tool-chest as claimed in claim 6, wherein the flange provided on the periphery of the central well is removably joined to the walls of said central well.

* * * * *